US005404929A

United States Patent [19]

Till

[11] Patent Number: 5,404,929

[45] Date of Patent: Apr. 11, 1995

[54] CASTING OF HIGH OXYGEN-AFFINITY METALS AND THEIR ALLOYS

[75] Inventor: Kenneth A. Till, Westmont, Ill.

[73] Assignee: Liquid Air Corporation, Walnut Creek, Calif.

[21] Appl. No.: 64,402

[22] Filed: May 18, 1993

[51] Int. Cl.[6] ..... B22D 23/00

[52] U.S. Cl. ..... 164/66.1; 164/259; 75/709; 75/10.17; 75/10.18; 266/207

[58] Field of Search ..... 164/259, 66.1, 68.7; 75/709, 10.17, 10.18, 558, 628, 621, 10.45; 266/207, 206

[56] References Cited

U.S. PATENT DOCUMENTS

| | | | |
|---|---|---|---|
| 3,400,752 | 9/1968 | Unsworth . | |
| 3,598,168 | 8/1971 | Clark | 164/493 |
| 4,089,678 | 5/1978 | Hanawalt . | |
| 4,211,269 | 7/1980 | Bentz et al. | 164/259 |
| 4,519,438 | 5/1985 | Grosso et al. | 164/259 |
| 4,549,598 | 10/1985 | Gervais et al. | 164/259 |
| 4,565,234 | 1/1986 | Rimbert | 164/66.1 |
| 4,657,587 | 4/1987 | Savard et al. . | |
| 4,791,977 | 12/1988 | Chandley | 164/66.1 |
| 4,806,156 | 2/1989 | Anderson et al. | 75/709 |
| 4,848,751 | 7/1989 | Lutgen et al. | 266/207 |
| 4,962,291 | 10/1990 | Fujita et al. | 75/10.17 |

FOREIGN PATENT DOCUMENTS

| | | | |
|---|---|---|---|
| 0387107 | 9/1990 | European Pat. Off. | 164/493 |
| 5211926 | 4/1977 | Japan | 164/259 |
| 56-119298 | 2/1983 | Japan . | |
| 56-119299 | 2/1983 | Japan . | |
| 8103953 | 6/1983 | Japan | 164/66.1 |
| 9212162 | 12/1984 | Japan | 164/66.1 |
| 220279 | 2/1925 | United Kingdom . | |
| 2092037 | 8/1982 | United Kingdom | 164/66.1 |
| 8000137 | 7/1980 | WIPO | 164/66.1 |

*Primary Examiner*—P. Austin Bradley
*Assistant Examiner*—James Miner
*Attorney, Agent, or Firm*—Malcolm B. Wittenberg

[57] ABSTRACT

A process for casting high oxygen affinity metals or metal alloys such as titanium through use of an induction furnace while preventing the pick up of contaminating gas by the metals or metal alloys during melting. An inert shielding gas such as nitrogen or argon or carbon dioxide is introduced as a liquid in a closed environment above the metal or metal alloys being melted such that there is preferably no more than approximately 1% contaminating gas in the gaseous environment proximate the surface of the molten metal or metal alloy. Simultaneously, the mold placed under the induction furnace is purged with a similar or different inert gas.

11 Claims, 2 Drawing Sheets

CASTING OF HIGH OXYGEN-AFFINITY METALS AND THEIR ALLOYS

TECHNICAL FIELD OF THE INVENTION

The present invention relates to a process for casting high oxygen-affinity metals and metal alloys through use of an induction furnace. In practicing the present invention, expensive and complex vacuum casting techniques are replaced with a semi-sealed environment containing inert shielding liquid gas for producing castings of exceedingly high quality.

BACKGROUND OF THE INVENTION

It is known that metals such as titanium, titanium alloys, nickel-based super alloys, stainless steel and lo-alloy steel exhibit an intensive affinity towards oxygen and nitrogen particularly when in a molten state. In fact, titanium shows such an extreme affinity to oxygen that it is oftentimes employed as an oxygen "getter." As such, when melting such metals and metal alloys for casting purposes and otherwise, it is necessary to provide a costly and elaborate vacuum system as an adjunct to an arc prelection beam furnace to prevent the pick up of contaminating gases.

It has been taught that molten metal could be continuously cast from a ladle into an ingot mold while shielding the molten metal with a liquified inert gas such as nitrogen (when the presence of this element in the metal is not harmful) or liquid argon. This is taught, for example, in British Patent No. 987190 which also teaches the use of an inert gas to shield the surface of molten metal in a ladle to avoid oxygen, hydrogen and nitrogen pick up from the surrounding atmosphere.

In electrical furnaces, molten metal comes from the heating of pieces of metal or of scrap metal which are progressively melted in the furnace while new pieces of metal or scrap are added throughout the melting phase.

It is known that almost any open surface of molten metal can be protected against oxygen, hydrogen or nitrogen pick up by blanketing with liquid argon, nitrogen or carbon dioxide snow. By incorporating inert gases at or above the surface of the molten metal, atmospheric oxygen and humidity-generating hydrogen can be purged/displaced from the surface of the melt to prevent contamination. The prior art has also considered protecting pieces of scrap metal or new stocks of metal in the stage of pre-heating above the liquid bath of molten metal prior to melting. The atmosphere above the metal is selected according to the nature of metals, alloyed metals, alloys or pure metals and is maintained above and around each element of the charge throughout the whole melting and holding operations from the very moment the charge begins to heat up to the moment the metal is tapped. Also dealing with metals which do not exhibit such a strong oxygen affinity, the practice of covering the surface of molten metal with liquid argon has been carried out and maintained until the metal is poured. However, metals, such as titanium, exhibit such a strong affinity toward oxygen that pouring such metals into a mold would negate the beneficial effects achieved in creating an inert atmosphere above the melt.

As noted in U.S. Pat. No. 4,806,156, attempts to maintain residual oxygen in a vessel at levels below 1% have not been entirely successful. This is particularly true when the level of molten metal in the furnace reaches about two-thirds of the height of the furnace. Oxygen concentration stabilizes at about 3–5% (volume concentration) at this height utilizing the foregoing patent teaching. Though still being considered as good protection as the atmosphere is approximately 20.9% oxygen, it is not completely satisfactory. This is obviously an acute problem in dealing with high oxygen affinity metals and their alloys such as titanium where even small quantities of oxygen can contaminate the charge and result in defects and anomalies which would translate into an unacceptable metal part or component.

When producing high grade metals and alloys of titanium and of other high affinity metals, for example, for the aeronautic industry, standard vacuum techniques are employed. When low grade metal and alloys are produced it is commonplace to engage in no protective measures to prevent oxygen contamination. There is currently a need to produce metals and alloys of high grade, but at a lower grade than that demanded by the aircraft industry, but at a much lower cost, which production under air cannot achieve.

It is thus an object of the present invention to provide a process for casting high oxygen affinity metals or metal alloys while avoiding the need to provide costly and complex vacuum systems.

It is a further object of the present invention to provide a process for casting high oxygen affinity metals while substantially preventing the pick up of contaminating gas during melting in an induction furnace.

These and further objects will be more readily appreciated when considering the following disclosure and appended drawings, wherein.

SUMMARY OF THE INVENTION

Figure 1:
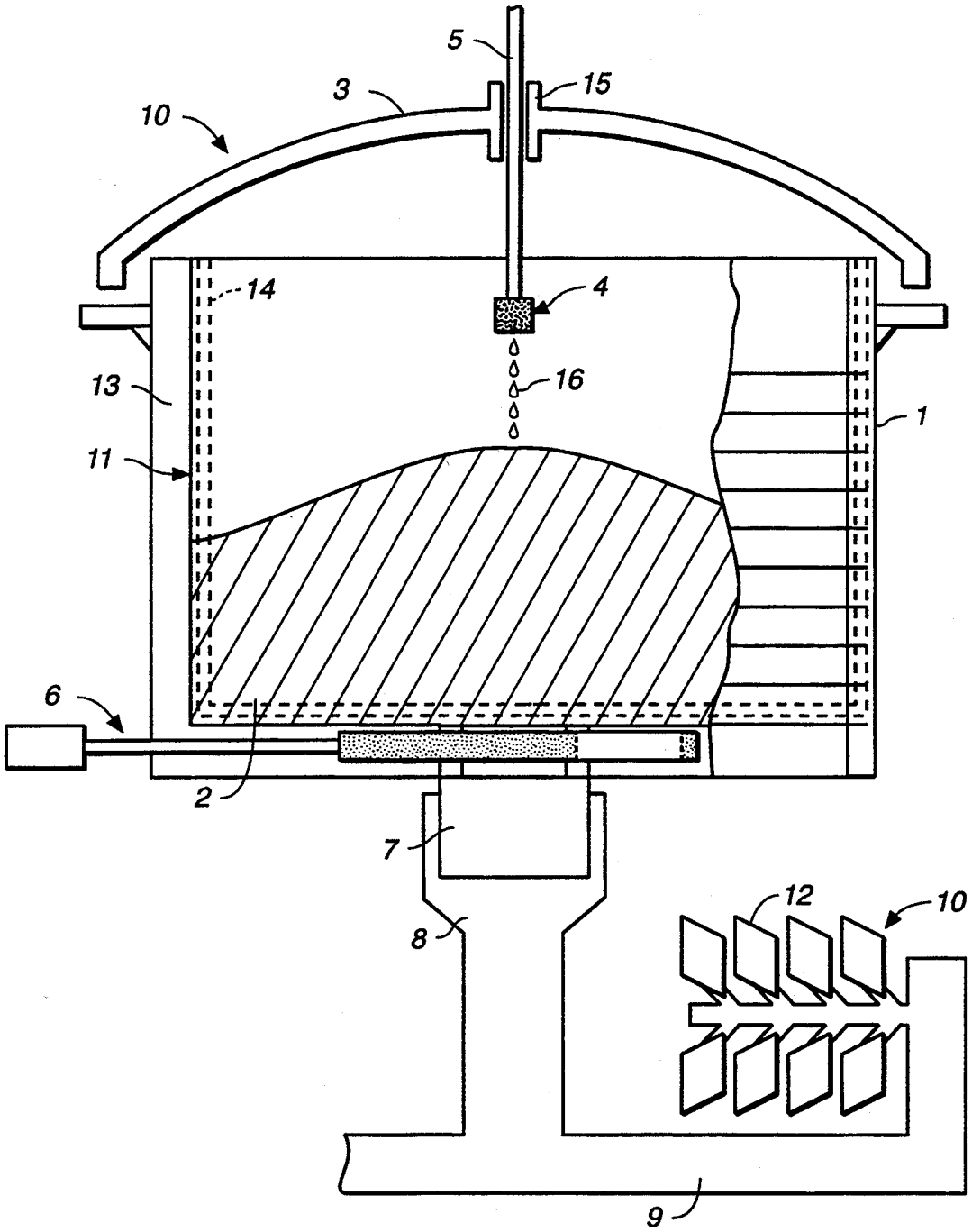
FIG. 1 depicts, in partial cross-section, an induction furnace operating pursuant to the present invention.

The present invention involves a process for casting high oxygen-affinity metals or metal alloys through the use of an induction furnace while substantially preventing the pick up of contaminating gases by said metals or metal alloys during their melting. The process comprises feeding the high oxygen affinity metals or metal alloys into the induction furnace forming a charge while introducing a suitable quantity of liquid inert shielding gas in a semi-sealed environment above the charge such that upon heating the charge, there is present no more than approximately 1% contaminating gases in the semi-sealed environment proximate the surface of the charge. The charge is thereupon melted and the melt passed through an inert gas shield gate located in the induction furnace so that the molten charge is discharged through gravity to a suitable mold or cavity.

DETAILED DESCRIPTION OF THE INVENTION

The present invention is applicable to investment and other permanent mold casting processes to provide high quality parts free of contamination, defects and other anomalies. Such castings have generally heretofore been made utilizing costly vacuum furnaces to achieve suitable protection against oxidation, alloy depletion, gas and pitting defects, and ceramic-related inclusions.

Standard vacuum casting techniques involve placing a mold, either preheated "hot" at 400°–2000° F. or "cold," at less than 400° F., into a vacuum chamber. The chamber is sealed and a vacuum pulled to a nominal pressure of 25–100 microns. An electrode metal or alloy is then arc melted into a water-cooled copper crucible or a pre-weighed stock is induction melted and emptied into a pre-placed mold or cavity. The filled mold is then allowed to cool a nominal 2–30 minutes so as not to damage the electrode and/or disrupt the subsequent feeding of the alloy during solidification. The entire process is costly in time and materials. Elimination of the costly use of vacuum casting processes to achieve high quality product meeting all specification requirements will provide non-vacuum foundries the means to compete in the same market as vacuum casting facilities. This is particularly true for those alloy families which require protective atmospheres to prevent the formation of surface oxides and matrix defects such as inclusions and gas porosity. Particularly when employing titanium alloys, great care must be taken for titanium has a marked affinity for oxygen and, as a consequence, casting net shapes requires an inert atmosphere in the furnace hot zone during melting.

Turning to the appended figures, the present process can be more readily visualized as means of providing high quality parts pursuant to stringent specification requirements without having to utilize costly vacuum casting facilities.

Induction furnace 10 shown in the appended figure is provided with sidewalls 13 defining the path of induction coils 1. Providing a current through induction coils 1 results in the melting of metal or metal alloy such as molten titanium 2 shown in profile with its meniscus within the furnace housing.

Cover 3 is sized to fit over sidewalls 13 in an abutting fashion so as to provide a semi-sealed environment 14 above molten metal 2. Located centrally of cover 3 is hole 15 allowing for the passage of tubular member 5 which is functionally connected to a source of liquified inert shielding gas. In practicing the present invention, such shielding gas is ideally a member selected from the group consisting of nitrogen and argon, with argon being preferred.

The shielding gas, in passing through element 5 is introduced to a powder-metal stainless steel diffuser 4 ideally having a particle size through less than 80 microns. Thereupon, the liquid inert shielding gas is introduced to the semi-sealed environment 14 as liquid droplets 16. In this environment inert shielding gas 16 is maintained above charge 2 at a Partial pressure of less than 3 atmospheres and, preferably, at a partial pressure between approximately 0.1 and 0.5 psig.

Figure 2:
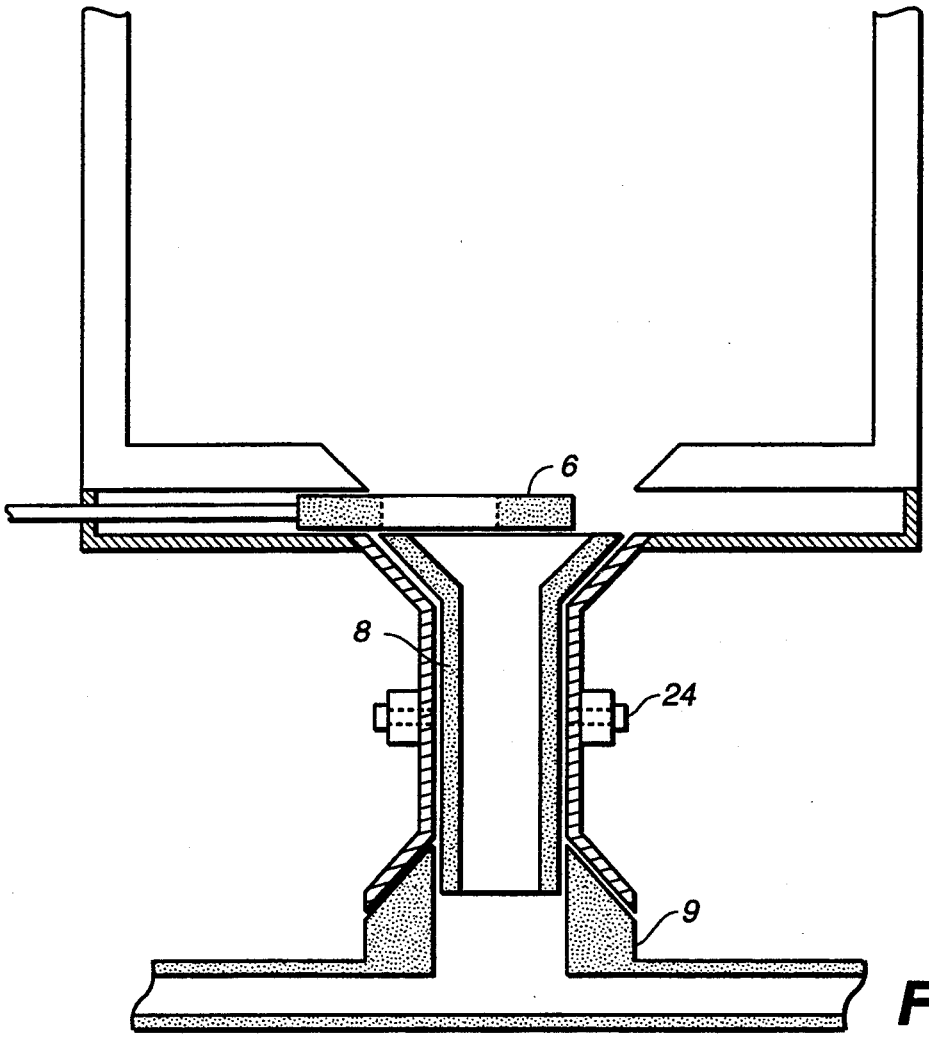
FIG. 2 represents, in partial cross-section, that portion of the induction furnace of FIG. 1 showing lower portions of the furnace providing detail of the discharge gate and other downstream elements.

Turning to FIG. 2, upon the metal and metal alloy 2 being fully melted, discharge gate 6 is opened either manually or through use of solenoid actuation allowing the melt to flow through an inert gas-shielded graphite or ceramic sleeve 7 and sprue 8 of mold 9. As such, the molten charge is discharged through gravity and, as a consequence, does not contact any contaminating gases in passing from the interior of induction furnace 10 into mold 9.

Any induction-type furnace can be employed in practicing the present invention or, for that matter, any furnace at all having a bottom which communicates through, for example, a sliding gate with a mold having vented orifices. As noted above, the top surface of the titanium or other metal or alloy molten bath is protected with a liquid inert gas such as argon during melting.

Figure 3:
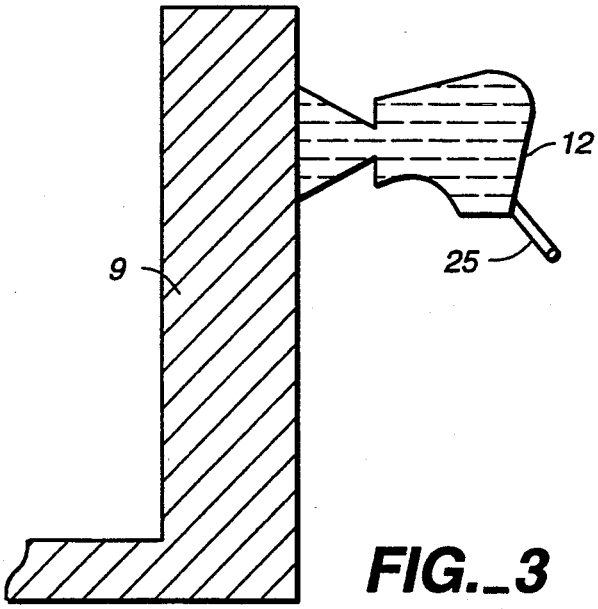
FIG. 3 represents, in cross-section, a detailed depiction of a mold element for use in the induction furnace of FIGS. 1 and 2.

Turning to FIG. 3, it is contemplated that for about 10 seconds or more before pouring liquid metal 2 into mold 9 forming part 12 that gaseous inert gas is injected at the top of the mold through input fitting 24 (FIG. 2) with a slight positive pressure to purge the entire mold 9. The purging atmosphere is vented through vent orifices 25 of the mold before or after molten metal 2 is poured into the mold which substantially avoids any oxidation of the molten metal which rapidly hardens in the mold.

In practicing this embodiment, it is contemplated that a positive pressure of inert gas be maintained above the molten metal at a value of $\leqq 1$ psig (absolute). Liquid inert gas flow rate should be $\leqq 1.5$ lbs/min/sq inch of molten metal surface while a value of $\leqq 1.25$ lbs./min/sq inch is most preferred. When purging the entire mold with inert gas, it is contemplated that the gaseous flow rate be maintained at a value of $\leqq 10$ cu feet/min. As noted, the inert gas is injected through the mold receptacle and it is contemplated this be done perpendicular to the flow of molten metal. It has been found that best results are achieved when injection of inert gas is carried out between the walls of the sprue and the discharge cone with an over-pressure such that gaseous inert gas slightly flows outside the mold receptacle at the top of it, avoiding air ingress during the pouring of the liquid metal in the mold which generally creates a pressurized pull of the inert gas to the exclusion of air.

A static/stationary or rotating/centrifugal mold system can be employed, the choice of mold system being discretionary and dictated by the part economics, intended part configuration and alloy type. After furnace 10 is tapped and the filled mold is removed, the furnace is ready for subsequent melting in minimal time. Generally, preparation for the next melt would include removal of residual metal such as titanium skull from melting zone followed by replacing the furnace graphite susceptor and tap sleeve 7 after which the next mold system is located under discharge gate 6.

I claim:

1. A process for casting high contaminating gas affinity metals or metal alloys through the use of a furnace having a bottom region which communicates with a mold having vented orifices, said process substantially preventing the pick-up of contaminating gases by said metals or metal alloys during their melting and subsequent casting, said process comprises feeding said high oxygen affinity metals or metal alloys into said furnace forming a charge, introducing a liquid inert shielding gas above said charge to lessen contamination of said charge upon heating and upon subsequent steps of the process proximate the surface of said charge, melting said charge and pouring said liquid metal or metal alloy into said mold and maintaining said liquid inert gas above said charge throughout said melting and pouring step, wherein for a period of approximately ten seconds or more before pouring said metal or metal alloy into said mold, gaseous inert gas is injected in the mold with an over-pressure to purge the mold, the purged atmosphere being vented through the vent orifices of the mold prior to or at the time the molten metal or metal alloy is poured into the mold thus substantially avoiding any contamination of said molten metal or metal alloy during pouring and during its solidification in the mold.

2. The process of claim 1 wherein said gaseous inert gas is maintained at a positive pressure≦approximately 1 psig. (absolute).

3. The process of claim 1 wherein said liquid inert gas flow rate is maintained at a level≦approximately 1.5 lbs./min/sq inch of molten metal or metal alloy surface area.

4. The process of claim 1 wherein said liquid inert gas flow rate is maintained at a level of≦approximately 1.25 lbs./min/sq inch of molten metal or metal alloy surface area.

5. The process of claim 1 wherein said gaseous inert gas is maintained at a flow rate of≦approximately 10 cu feet/min.

6. The process of claim 1 wherein the injection of gaseous inert gas through said mold is maintained perpendicular to the flow of molten metal or metal alloy from said furnace to said mold.

7. The process of claim 1 wherein the contaminating gases comprise oxygen from air and wherein said liquid inert gas is selected from the group comprising liquid argon, liquid nitrogen and/or carbon dioxide snow in order to substantially avoid any oxidation of said molten metal or metal alloy.

8. The process of claim 7 wherein said liquid inert gas suitable quantity is such that during the heating, melting and pouring steps, there is present no more than approximately 5% (vol.) of $O_2$.

9. The process of claim 7 wherein said liquid inert gas suitable quantity is such that during the heating, melting and pouring steps, there is present no more than approximately 1% (vol.) of $O_2$.

10. The process according to claim 1 wherein said metal or metal alloys comprises titanium or titanium alloys.

11. The process according to claim 1, wherein the inert liquid gas is different from the gaseous inert gas used to purge the mold.

* * * * *